US011236411B2

(12) United States Patent
Nasu et al.

(10) Patent No.: US 11,236,411 B2
(45) Date of Patent: Feb. 1, 2022

(54) ALLOYED STEEL POWDER FOR POWDER METALLURGY AND IRON-BASED MIXED POWDER FOR POWDER METALLURGY

(71) Applicant: JFE STEEL CORPORATION, Tokyo (JP)

(72) Inventors: Nao Nasu, Tokyo (JP); Takuya Takashita, Tokyo (JP); Akio Kobayashi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/979,170

(22) PCT Filed: Mar. 22, 2019

(86) PCT No.: PCT/JP2019/012220

§ 371 (c)(1),
(2) Date: Sep. 9, 2020

(87) PCT Pub. No.: WO2019/188833

PCT Pub. Date: Oct. 3, 2019

(65) Prior Publication Data

US 2021/0002748 A1 Jan. 7, 2021

(30) Foreign Application Priority Data

Mar. 26, 2018 (JP) ..... JP2018-058693

(51) Int. Cl.

| | |
|---|---|
| ***C22C 33/02*** | (2006.01) |
| ***C22C 38/12*** | (2006.01) |
| ***B22F 3/10*** | (2006.01) |
| ***C22C 38/16*** | (2006.01) |
| ***B22F 1/00*** | (2006.01) |

(52) U.S. Cl.

CPC ..... *C22C 38/12* (2013.01); *B22F 1/0011* (2013.01); *B22F 1/0085* (2013.01); *B22F 3/10* (2013.01); *C22C 33/0207* (2013.01); *C22C 33/0264* (2013.01); *C22C 38/16* (2013.01); *B22F 2301/35* (2013.01); *B22F 2303/10* (2013.01)

(58) Field of Classification Search

CPC ..... C22C 33/0207

See application file for complete search history.

(56) References Cited

U.S. PATENT DOCUMENTS

| | | | |
|---|---|---|---|
| 3,787,205 | A | 1/1974 | Church |
| 3,897,618 | A | 8/1975 | Church |
| 6,905,530 | B2 | 6/2005 | Yoshimura et al. |
| 7,998,238 | B2 | 8/2011 | Takayama et al. |
| 8,734,561 | B2 | 5/2014 | Larsson |
| 10,265,766 | B2 | 4/2019 | Maetani et al. |
| 10,618,110 | B2 | 4/2020 | L'Esperance et al. |
| 10,710,155 | B2 | 7/2020 | Takashita et al. |
| 2009/0142220 | A1 | 6/2009 | Hwang et al. |
| 2010/0154588 | A1 | 6/2010 | Berg et al. |
| 2011/0176950 | A1 | 7/2011 | Unami et al. |
| 2013/0039796 | A1 | 2/2013 | L'Esperance et al. |
| 2013/0302202 | A1 | 11/2013 | Larsson |
| 2016/0136727 | A1 | 5/2016 | Maetani et al. |
| 2018/0193911 | A1 | 7/2018 | Kobayashi et al. |

FOREIGN PATENT DOCUMENTS

| | | | |
|---|---|---|---|
| CN | 1297389 | A | 5/2001 |
| CN | 1780927 | A | 5/2006 |
| CN | 101797640 | A | 8/2010 |
| CN | 102165083 | A | 8/2011 |
| CN | 102933731 | A | 2/2013 |
| CN | 105263653 | A | 1/2016 |
| JP | S5935601 | A | 2/1984 |
| JP | H11302787 | A | 11/1999 |
| JP | 2009173958 | A | 8/2009 |
| JP | 2010529302 | A | 8/2010 |
| JP | 2013508558 | A | 3/2013 |
| JP | 2013204112 | A | 10/2013 |
| WO | 2017043094 | A1 | 3/2017 |
| WO | 2017047100 | A1 | 3/2017 |

OTHER PUBLICATIONS

Stewart, J. L., J. J. Williams, and Nikhilesh Chawla. "Influence of thermal aging on the microstructure and mechanical behavior of dual-phase, precipitation-hardened, powder metallurgy stainless steels." Metallurgical and Materials Transactions A 43.1 (2012): 124-135.*

May 7, 2021, Office Action issued by the China National Intellectual Property Administration in the corresponding Chinese Patent Application No. 201980020422 6 with English language search report.

Dec. 10, 2020, the Extended European Search Report issued by the European Patent Office in the corresponding European Patent Application No. 19777638.8.

Qing-Dong Liu et al., Comparative Study on Austenite Decomposition and Cu Precipitation During Continuous Cooling Transformation, Metallurgical and Materials Transactions A, Jan. 2013, pp. 163-171, vol. 44A.

Jun. 18, 2019, International Search Report issued in the International Patent Application No. PCT/JP2019/012220.

Nov. 9, 2021, Office Action issued by the Korean Intellectual Property Office in the corresponding Korean Patent Application No. 10-2020-7030246 with English language concise statement of relevance.

* cited by examiner

*Primary Examiner* — Christopher S Kessler
(74) *Attorney, Agent, or Firm* — Kenja IP Law PC

(57) ABSTRACT

Disclosed is an alloyed steel powder for powder metallurgy from which sintered parts that do not contain expensive Ni, or Cr or Mn susceptible to oxidation, that have excellent compressibility, and that have high strength in an as-sintered state can be obtained. The alloyed steel powder for powder metallurgy has: a chemical composition containing Mo: 0.5 mass % to 2.0 mass % and Cu: 1.0 mass % to 8.0 mass %, with the balance being Fe and inevitable impurities; and a microstructure in which an FCC phase is present at a volume fraction of 0.5% to 10.0%.

3 Claims, No Drawings

ALLOYED STEEL POWDER FOR POWDER METALLURGY AND IRON-BASED MIXED POWDER FOR POWDER METALLURGY

TECHNICAL FIELD

This disclosure relates to an alloyed steel powder for powder metallurgy, and, in particular, to an alloyed steel powder for powder metallurgy having excellent compressibility from which sintered parts having high strength in an as-sintered state can be obtained. This disclosure also relates to an iron-based mixed powder for powder metallurgy containing the above-described alloyed steel powder for powder metallurgy.

BACKGROUND

Powder metallurgical technology enables manufacture of complicated-shape parts with dimensions very close to the products' shapes (i.e., near net shapes). This technology has been widely used in the manufacture of various parts, including automotive parts.

Recently, miniaturization and weight reduction of components such as automotive parts have been required, and there are increasing demands for further strengthening of sintered bodies produced by powder metallurgy. Also, with increasing demands for cost reduction in the world, the need for low-cost and high-quality alloyed steel powder for powder metallurgy is increasing in the field of powder metallurgy.

In most cases, strengthening of alloyed steel powder for powder metallurgy is achieved by adding Ni and many other alloying elements. Among them, Ni is widely used since it is an element that improves hardenability, that is less prone to solid solution strengthening, and that has good compressibility during forming. In addition, since Ni is not easily oxidized, there is no need to pay special attention to the heat treatment atmosphere when producing alloyed steel powder, and Ni is considered as an easy-to-handle element. This is another reason why Ni is widely used.

For example, JP 2010-529302 A (PTL 1) proposes an alloyed steel powder to which Ni, Mo, and Mn are added as alloying elements for the purpose of strengthening.

Further, J P 2013-204112 A (PTL 2) proposes the use of an alloyed steel powder containing alloying elements such as Cr, Mo, and Cu and mixed with a reduced amount of C.

JP 2013-508558 A (PTL 3) proposes a method of using an alloyed steel powder containing alloying elements such as Ni, Cr, Mo, and Mn and mixed with graphite and so on.

CITATION LIST

Patent Literature

PTL 1: JP 2010-529302 A
PTL 2: JP 2013-204112 A
PTL 3: JP 2013-508558 A

SUMMARY

Technical Problem

However, in addition to high cost, Ni has a disadvantage in that supply is unstable and price fluctuations are large. Therefore, the use of Ni is not suitable for cost-reduction, and there are increasing needs for alloyed steel powder that does not contain Ni.

Accordingly, it is conceivable to improve hardenability by adding an alloying element other than Ni. However, when adding an alloying element other than Ni, although hardenability is improved, the compressibility during forming of alloyed steel powder is reduced due to solid solution strengthening of the alloying element, presenting a dilemma that the strength of the sintered body does not increase.

Further, it has been proposed to use Cr or Mn as an alloying element other than Ni. However, since Cr and Mn are easily oxidized, oxidation occurs during sintering, leading to deterioration of the mechanical properties of the sintered body. Therefore, instead of using Cr or Mn that is easily oxidized, there has been demand for the use of an element that is difficult to oxidize.

Furthermore, in powder metallurgy, to manufacture high-strength parts, the powder is typically strengthened by being subjected to forming and sintering, followed by heat treatment. However, heat treatment performed twice, that is, heat treatment after sintering, causes an increase in manufacturing cost, and thus the above process can not meet the demand for cost reduction. Therefore, for further cost reduction, sintered bodies are required to have excellent strength in an as-sintered state without subjection to heat treatment.

For the above reasons, alloyed steel powder is required to satisfy all of the following requirements:

(1) not containing expensive Ni;
(2) having excellent compressibility;
(3) not containing elements susceptible to oxidation; and
(4) having excellent strength as a sintered body in an "as-sintered" state (without being subjected to further heat treatment).

The alloyed steel powder instances proposed in PTLs 1 to 3 contain Ni, and thus fail to satisfy the requirement (1). Further, the alloyed steel powder instances proposed in PTLs 1 to 3 contain an easily oxidized element, Cr or Mn, and thus fail to satisfy the requirement (3).

Furthermore, in PTL 2, the compressibility of the mixed powder during forming is improved by reducing the C content to a specific range. However, the method proposed in PTL 2 merely attempts to improve the compressibility of the mixed powder by reducing the amount of C to be mixed with the alloyed steel powder (such as graphite powder), and can not improve the compressibility of the alloyed steel powder itself. Therefore, in this method, it is impossible to satisfy the requirement (2). Further, in the method proposed in PTL 2, in order to compensate for strength decrease by reducing the C content, it is necessary to set the cooling rate during quenching after sintering to 2° C./s or higher. In order to perform such control of the cooling rate, it is necessary to remodel the manufacturing facility, resulting in increased manufacturing costs.

Further, in the method proposed in PTL 3, in order to improve the mechanical properties of a sintered body, it is necessary to perform additional heat treatment after sintering, such as carburizing, quenching, and tempering. Therefore, this method fails to satisfy the requirement (4).

Thus, alloyed steel powder for powder metallurgy that satisfies all of the requirements (1) to (4) has not yet been developed.

It would thus be helpful to provide an alloyed steel powder for powder metallurgy from which sintered parts that do not contain expensive Ni, or Cr or Mn susceptible to oxidation, that have excellent compressibility, and that have high strength in an as-sintered state can be obtained. It would also be helpful to provide an iron-based mixed powder for powder metallurgy that contains the above-described alloyed steel powder for powder metallurgy.

Solution to Problem

The present disclosure was completed to address the above-mentioned issues, and primary features thereof are described below.

1. An alloyed steel powder for powder metallurgy comprising: a chemical composition containing (consisting of) Mo: 0.5 mass % to 2.0 mass %, and Cu: 1.0 mass % to 8.0 mass %, with the balance being Fe and inevitable impurities; and a microstructure in which an FCC phase is present at a volume fraction of 0.5% to 10.0%.

2. An iron-based mixed powder for powder metallurgy, comprising: the alloyed steel powder for powder metallurgy as recited in 1; and a graphite powder in an amount of 0.2 mass % to 1.2 mass % with respect to a total amount of the iron-based mixed powder for powder metallurgy.

3. The iron-based mixed powder for powder metallurgy according to 2, further comprising a Cu powder in an amount of 0.5 mass % to 4.0 mass % with respect to a total amount of the iron-based mixed powder for powder metallurgy.

Advantageous Effect

The alloyed steel powder for powder metallurgy according to the present disclosure does not contain Ni that is an expensive alloying element, and thus can be produced at low cost. Further, since the alloyed steel powder for powder metallurgy disclosed herein does not contain an alloying element susceptible to oxidation, such as Cr or Mn, strength reduction of a sintered body due to oxidation of such alloying element does not occur. Furthermore, in addition to the hardenability improving effect of Mo and Cu, the effect of improving the compressibility of an alloyed steel powder obtained by the presence of an FCC (face-centered cubic) phase at a specific volume fraction enables production of a sintered body having excellent strength without performing heat treatment after sintering.

DETAILED DESCRIPTION

[Alloyed Steel Powder for Powder Metallurgy]

[Chemical Composition]

The following provides details of a method of carrying out the present disclosure. In the present disclosure, it is important that the alloyed steel powder for powder metallurgy (which may also be referred to simply as the "alloyed steel powder") has the above-described chemical composition. Thus, the reasons for limiting the chemical composition of the alloyed steel powder as stated above will be described first. As used herein, the "%" representations below relating to the chemical composition are in "mass %" unless stated otherwise.

In order to achieve both the requirement of low cost and the requirement of sufficient strength in an as-quenched state, an alloying element with properties equivalent to or better than that of Ni needs to be used instead of Ni. Therefore, the aforementioned alloying elements are required to provide excellent hardenability sufficient for replacing Ni. The effectiveness of the hardenability improvement effect of the hardenability-improving elements is Mn>Mo>P>Cr>Si>Ni>Cu>S in the descending order.

Furthermore, in production of a common alloyed steel powder, after producing a powder using a atomizing method or the like, the powder is subjected to heat treatment for reduction (finish-reduction). Therefore, the alloying elements contained in the alloyed steel powder are required to be easily reduced under normal finish-reduction conditions. The easiness of reduction in a $H_2$ atmosphere at 950° C., which is a common finish-reduction condition, is Mo>Cu>S>Ni in the descending order.

Therefore, both Mo and Cu have properties such that the hardenability is equivalent to or higher than Ni and they are more susceptible to $H_2$ reduction than Ni. Therefore, the alloyed steel powder according to the present disclosure contains Mo and Cu as alloying elements instead of Ni.

Mo: 0.5% to 2.0%

Mo is a hardenability-improving element as described above. In order to sufficiently exhibit the hardenability-improving effect, the Mo content needs to be 0.5% or more. Therefore, the Mo content of the alloyed steel powder is 0.5% or more, and preferably 1.0% or more. On the other hand, if the Mo content exceeds 2.0%, the compressibility of the alloyed steel powder during pressing will decrease due to the high alloy content, causing a decrease in the density of the formed body. As a result, the increase in strength due to the improvement in hardenability is offset by the decrease in strength due to the decrease in density, resulting in a decrease in the strength of the sintered body. Therefore, the Mo content is 2.0% or less, and preferably 1.5% or less.

Cu: 1.0% to 8.0%

Cu, like Mo, is a hardenability-improving element. In order to sufficiently exhibit the hardenability-improving effect, the Cu content needs to be 1.0% or more. Therefore, the Cu content of the alloyed steel powder is 1.0% or more, preferably 2.0% or more, and more preferably 3.0% or more. On the other hand, as can be seen from the Fe—Cu phase diagram, if the Cu content is more than 8.0%, Cu is melted at 1096° C. or higher. Since the powder is heated to near 1000° C. during finish-reduction, in order to prevent melting of Cu during the finish-reduction, the Cu content is set to 8.0% or less, preferably 6.0% or less, and more preferably 4.0% or less.

The alloyed steel powder for powder metallurgy according to the present disclosure has a chemical composition that contains Mo and Cu in the above ranges, with the balance being Fe and inevitable impurities.

The inevitable impurities are not particularly limited, and may include any elements. The inevitable impurities may include, for example, at least one selected from the group consisting of C, S, O, N, Mn, and Cr. The contents of these elements as inevitable impurities are not particularly limited, yet preferably fall within the following ranges. By setting the contents of these impurity elements in the following ranges, it is possible to further improve the compressibility of the alloyed steel powder.

C: 0.02% or less

O: 0.3% or less, and more preferably 0.25% or less

N: 0.004% or less

S: 0.03% or less

Mn: 0.5% or less

Cr: 0.2% or less

[Microstructure]

In the present disclosure, it is important that the alloyed steel powder for powder metallurgy has a microstructure in which an FCC phase is present at a volume fraction of 0.5% to 10.0%. Since the FCC phase is soft, the presence of the FCC phase can improve the compressibility of the alloyed steel powder itself. Improved compressibility increases the density of the formed body and consequently increases the strength of the sintered body. To obtain the above effects, the volume fraction of the FCC phase is set to 0.5% or more, preferably 1.5% or more, and more preferably 2.5% or more. On the other hand, if the volume fraction of the FCC phase is higher than 10.0%, although the effect of increasing the forming density and the sintering density is obtained, the microstructure is softened with an increase in the FCC phase, causing a reduction in the tensile strength. Therefore, the volume fraction of the FCC phase is 10.0% or less, preferably 8.0% or less, and more preferably 4.0% or less.

The volume fraction of the FCC phase may be measured by X-ray diffraction. Specifically, from the diffraction profile, a peak area $I_{FCC}$ of (200) and (220) planes, which are planes of the FCC phase of Cu, and a peak area $I_{\alpha}$ of (200) and (211) planes, which are planes of the BCC phase of Fe, are obtained, and calculated as follows: a volume fraction of the FCC phase=$I_{FCC}/(I_{FCC}+I_{\alpha})\times 100(\%)$. The peak corresponding to the FCC phase of Cu and the peak corresponding to the FCC phase of Fe are overlapped, and usually cannot be separated. Therefore, the volume fraction of the FCC phase obtained as described above can be regarded as the sum of the volume fractions of the FCC phases of Cu and Fe.

The volume fraction of the FCC phase can be adjusted, as described later, by controlling the cooling rate during finish-reduction in production of alloyed steel powder.

[Iron-Based Mixed Powder for Powder Metallurgy]

The iron-based mixed powder for powder metallurgy in one embodiment of the present disclosure (which may also be referred to simply as the "mixed powder") contains the above-described alloyed steel powder for powder metallurgy and a graphite powder as an alloying powder. Further, the mixed powder in another embodiment contains the above-described alloyed steel powder for powder metallurgy, and a graphite powder and a Cu powder as alloying powders. Hereinafter, the components contained in the iron-based mixed powder for powder metallurgy will be described. In the following, the addition amount of each alloying powder contained in the mixed powder will be represented as the ratio (mass %) of the mass of the alloying powder to the mass of the entire mixed powder (excluding the lubricant) unless otherwise specified. In other words, the amount of each alloying powder added to the mixed powder is expressed by the ratio (mass %) of the mass of the alloying powder to the total mass of the alloyed steel powder and the alloying powder(s).

[Alloyed Steel Powder for Powder Metallurgy]

The iron-based mixed powder for powder metallurgy according to the present disclosure contains, as an essential component, the alloyed steel powder for powder metallurgy having the above-described chemical composition and microstructure. Therefore, the mixed powder contains Fe derived from the alloyed steel powder. As used herein, the term "iron-based" means that the Fe content (in mass %) defined as the ratio of the mass of Fe contained in the mixed powder to the mass of the entire mixed powder is 50% or more. The Fe content is preferably 80% or more, more preferably 85% or more, and even more preferably 90% or more. Fe contained in the mixed powder may all be derived from the alloyed steel powder.

[Graphite Powder]

Graphite Powder: 0.2% to 1.2%

C, which constitutes the graphite powder, further increases the strength of a sintered body by providing solid solution strengthening and a hardenability-improving effect when dissolved as a solute in Fe during sintering. When a graphite powder is used as an alloying powder, in order to obtain the above-described effect, the addition amount of the graphite powder is 0.2% or more, preferably 0.4% or more, and more preferably 0.5% or more. On the other hand, when the addition amount of the graphite powder exceeds 1.2%, the sintered body becomes hypereutectoid, forming a large amount of cementite precipitates, which ends up reducing the strength of the sintered body. Therefore, when a graphite powder is used, the addition amount of the graphite powder is 1.2% or less, preferably 1.0% or less, and more preferably 0.8% or less.

[Cu Powder]

Cu Powder: 0.5% to 4.0%

The iron-based mixed powder for powder metallurgy in one embodiment of the present disclosure may further optionally contain a Cu powder. A Cu powder has the effect of improving the hardenability, and accordingly increasing the strength of the sintered body. Further, a Cu powder is melted into liquid phase during sintering, and has the effect of causing particles of the alloyed steel powder to stick to each other. When a Cu powder is used as an alloying powder, in order to obtain the above-described effect, the addition amount of the Cu powder is 0.5% or more, preferably 0.7% or more, and more preferably 1.0% or more. On the other hand, when the addition amount of the Cu powder is more than 4.0%, the tensile strength of the sintered body is lowered by a reduction in the sintering density caused by the expansion of Cu. Therefore, when a Cu powder is used, the addition amount of the Cu powder is 4.0% or less, preferably 3.0% or less, and more preferably 2.0% or less.

In one embodiment of the present disclosure, the iron-based mixed powder for powder metallurgy may be made of the above-described alloyed steel powder and a graphite powder. In another embodiment, the iron-based mixed powder for powder metallurgy may be made of the above-described alloyed steel powder, a graphite powder, and a Cu powder.

[Lubricant]

In one embodiment, the iron-based mixed powder for powder metallurgy may further optionally contain a lubricant. By adding a lubricant, it is possible to facilitate removal of a formed body from the mold.

Any lubricant may be used without any particular limitation. The lubricant may be, for example, at least one selected from the group consisting of a fatty acid, a fatty acid amide, a fatty acid bisamide, and a metal soap. Among them, it is preferable to use a metal soap such as lithium stearate or zinc stearate, or an amide-based lubricant such as ethylene bisstearamide.

The addition amount of the lubricant is not particularly limited, yet from the viewpoint of further enhancing the addition effect of the lubricant, it is preferably 0.1 parts by mass or more, and more preferably 0.2 parts by mass or more, with respect to the total of 100 parts by mass of the alloyed steel powder and alloying powder(s). On the other hand, by setting the addition amount of the lubricant to 1.2 parts by mass or less with respect to the total of 100 parts by mass of the alloyed steel powder and alloying powder(s), it is possible to reduce the proportion of non-metals in the entire mixed powder, and further increase the strength of the sintered body. Therefore, the addition amount of the lubricant is preferably 1.2 parts by mass or less with respect to the total of 100 parts by mass of the alloyed steel powder and alloying powder(s).

In one embodiment of the present disclosure, the iron-based mixed powder for powder metallurgy may be made of the above-described alloyed steel powder, graphite powder, and lubricant. In another embodiment, the iron-based mixed powder for powder metallurgy may be made of the above-described alloyed steel powder, graphite powder, Cu powder, and lubricant.

[Method of Producing Alloyed Steel Powder]

Next, a method of producing an alloyed steel powder for powder metallurgy according to one embodiment of the present disclosure will be described.

The method of producing the alloyed steel powder for powder metallurgy according to the present disclosure is not particularly limited, and the alloyed steel powder may be produced in any way. However, the alloyed steel powder is preferably produced using an atomizing method. In other words, the alloyed steel powder for powder metallurgy according to the present disclosure is preferably an atomized powder. Thus, the following describes the production of the alloyed steel powder using an atomizing method.

[Atomization]

First, to prepare a molten steel having the above-described chemical composition, the molten steel is formed into a precursor powder (raw powder) using an atomizing method. As the atomizing method, it is possible to use any of a water atomizing method and a gas atomizing method, it is preferable to use a water atomizing method from the perspective of productivity. In other words, the alloyed steel powder for powder metallurgy according to the present disclosure is preferably a water-atomized powder.

[Drying and Classification]

Then, the powder produced by the atomizing method is dried, if necessary (optionally), and subjected to classification. In the classification, it is preferable to use a powder that has passed through a sieve (80-mesh) having an opening diameter of 180 μm defined by JIS Z 8801.

[Finish-Reduction]

Then, the finish-reduction (heat treatment) is performed. Through the finish-reduction, decarburization, deoxidation, and denitrification of the alloyed steel powder are accomplished. The atmosphere for the finish-reduction is preferably a reducing atmosphere, and more preferably a hydrogen atmosphere. In this heat treatment, it is preferable that the temperature be raised, held at a predetermined soaking temperature in the soaking zone, and then lowered. The soaking temperature is preferably 800° C. to 1000° C. Below 800° C., the reduction of the alloyed steel powder is insufficient. On the other hand, above 1000° C., the sintering progresses excessively, making the crushing process following the finish-reduction difficult. Further, since the decarburization, deoxidation, and denitrification of the alloyed steel powder is accomplished sufficiently at 1000° C. or lower, it is preferable to set the soaking temperature to 800° C. to 1000° C. from the perspective of cost reduction.

Further, the cooling rate in the process of lowering the temperature in the finish-reduction is 20° C./min or lower, and preferably 10° C./min or lower. When the cooling rate is 20° C./min or lower, it is possible to cause an FCC phase to precipitate in a desired amount in the microstructure of the alloyed steel powder after the finish-reduction.

[Grinding and Classification]

The alloyed steel powder after the finish-reduction is in a state where particles aggregate through the sintering. Therefore, in order to obtain a desired particle size, it is preferable to perform grinding and classification by sieving into 180 μm or less.

[Method of Producing Mixed Powder]

Furthermore, in production of the iron-based mixed powder for powder metallurgy, the alloyed steel powder obtained through the above procedure is optionally added and mixed with a graphite powder, a Cu powder, a lubricant, and so on.

[Method of Producing Sintered Body]

The alloyed steel powder and the mixed powder according to the present disclosure can be formed into a sintered body in any way without limitation to a particular method. Hereinafter, an exemplary method of producing a sintered body will be described.

First, powder is fed into a mold and pressed therein. At this point, the pressing force is preferably set to 400 MPa to 1000 MPa. When the pressing force is below 400 MPa, the density of the formed body is low, and the strength of the sintered body is reduced. When the pressing force is above 1000 MPa, the load on the mold is increased, the mold life is shortened, and the economic advantage is lost. The temperature during pressing preferably ranges from the room temperature (about 20° C.) to 160° C. Prior to the pressing, it is also possible to add a lubricant to the mixed powder for powder metallurgy. In this case, the final amount of the lubricant contained in the mixed powder for powder metallurgy to which the lubricant has been added is preferably 0.1 parts by mass to 1.2 parts by mass with respect to the total of 100 parts by mass of the alloyed steel powder and alloying powder(s).

The resulting formed body is then sintered. The sintering temperature is preferably 1100° C. to 1300° C. When the sintering temperature is below 1100° C., the sintering does not proceed sufficiently. On the other hand, the sintering proceeds sufficiently at or below 1300° C. Accordingly, a sintering temperature above 1300° C. leads to an increase in the production cost. The sintering time is preferably from 15 minutes to 50 minutes. A sintering time shorter than 15 minutes results in insufficient sintering. On the other hand, the sintering proceeds sufficiently in 50 minutes or less. Accordingly, a sintering time longer than 50 minutes causes a remarkable increase in cost. In the process of lowering the temperature after the sintering, it is preferable to perform cooling in the sintering furnace at a cooling rate of 20° C./min to 40° C./min. This is a normal cooling rate range in a conventional sintering furnace.

EXAMPLES

More detailed description is given below, based on examples. The following examples merely represent preferred examples, and the disclosure is not limited to these examples.

Example 1

Alloyed steel powder (pre-alloyed steel powder) samples having chemical compositions containing Mo and Cu in the amounts listed in Table 1, with the balance being Fe and inevitable impurities, were produced by a water atomizing method. Each resulting alloyed steel powder (water-atomized powder) sample was then subjected to finish-reduction to obtain an alloyed steel powder for powder metallurgy. In the finish-reduction, each sample was soaked at 950° C. in a hydrogen atmosphere and cooled at a rate of 10° C./min.

The volume fraction of the FCC phase in each resulting alloyed steel powder for powder metallurgy was measured by the above-described method. The measurement results are listed in Table 1.

Then, each alloyed steel powder after the finish-reduction was added with a graphite powder as an alloying powder and ethylene bisstearamide (EBS) as a lubricant, and mixed while being heated in a high-speed mixer to obtain an iron-based mixed powder for powder metallurgy. The addition amount of a graphite powder was 0.5 mass % in terms of the ratio of the mass of the graphite powder to the total mass of the alloyed steel powder and the graphite powder. Further, the addition amount of EBS was 0.5 parts by mass with respect to the total of 100 parts by mass of the alloyed steel powder and the alloying powder.

Each obtained iron-based mixed powder for powder metallurgy was subjected to forming at a compacting pressure of 686 MPa, and a ring-shaped formed body having an outer diameter of 38 mm, an inner diameter of 25 mm, and a height of 10 mm, and a flat formed body defined in JIS Z 2550 were obtained. As an indicator of the compressibility of the powder, the dimensions and weight of each resulting ring-shaped formed body was measured to calculate the density (forming density). The measurement results are listed in Table 1.

Then, each formed body was sintered under the conditions of 1130° C. for 20 minutes in an RX gas (propane-modified gas) atmosphere to obtain a sintered body, and the outer diameter, the inner diameter, the height, and the weight of the sintered body were measured to calculate the density (sintering density). The measurement results are listed in Table 1.

Furthermore, using each sintered body obtained by sintering the flat formed body as a test piece, the tensile strength of the sintered body was measured. The measurement results are listed in Table 1.

TABLE 1

| | Mixed powder | | | | | | | | | |
|---|---|---|---|---|---|---|---|---|---|---|
| | Alloyed steel powder | | | | Alloying powder | | | | | |
| | Chemical composition * (mass %) | | Cooling rate after final reduction | Volume fraction of FCC phase | Addition amount (mass %) | | Formed body | Sintered body | | |
| No. | Mo | Cu | (° C./min) | (%) | Graphite powder | Cu powder | Density ($Mg/m^3$) | Density ($Mg/m^3$) | Tensile strength (MPa) | Remarks |
| 1 | 0.3 | 3.0 | 10 | 2.8 | 0.5 | 0 | 7.14 | 7.11 | 683 | Comparative example |
| 2 | 0.5 | 3.0 | 10 | 2.8 | 0.5 | 0 | 7.13 | 7.10 | 821 | Example |
| 3 | 1.0 | 3.0 | 10 | 2.8 | 0.5 | 0 | 7.11 | 7.08 | 913 | Example |
| 4 | 1.5 | 3.0 | 10 | 2.8 | 0.5 | 0 | 7.10 | 7.07 | 989 | Example |
| 5 | 2.0 | 3.0 | 10 | 2.8 | 0.5 | 0 | 7.07 | 7.04 | 884 | Example |
| 6 | 2.3 | 3.0 | 10 | 2.8 | 0.5 | 0 | 7.03 | 7.00 | 791 | Comparative example |
| 7 | 1.5 | 0.5 | 10 | 0.1 | 0.5 | 0 | 7.03 | 7.01 | 796 | Comparative example |
| 8 | 1.5 | 1.0 | 10 | 0.7 | 0.5 | 0 | 7.05 | 7.03 | 831 | Example |
| 9 | 1.5 | 2.0 | 10 | 1.7 | 0.5 | 0 | 7.08 | 7.05 | 921 | Example |
| 10 | 1.5 | 3.0 | 10 | 2.8 | 0.5 | 0 | 7.10 | 7.07 | 989 | Example |
| 11 | 1.5 | 4.0 | 10 | 4.9 | 0.5 | 0 | 7.12 | 7.09 | 964 | Example |
| 12 | 1.5 | 6.0 | 10 | 7.9 | 0.5 | 0 | 7.13 | 7.10 | 921 | Example |
| 13 | 1.5 | 8.0 | 10 | 9.8 | 0.5 | 0 | 7.15 | 7.12 | 879 | Example |
| 14 | 1.5 | 10.0 | 10 | 10.5 | 0.5 | 0 | 7.18 | 7.15 | 790 | Comparative example |

* The balance is Fe and inevitable impurities.

Example 2

Alloyed steel powder samples, mixed powder samples, formed bodies, and sintered bodies were prepared under the same conditions as in Example 1 except that the cooling rate after the finish-reduction was changed, and were evaluated in the same manner as in Example 1. The production conditions and evaluation results are listed in Table 2.

TABLE 2

| | Mixed powder | | | | | | | | | |
|---|---|---|---|---|---|---|---|---|---|---|
| | Alloyed steel powder | | | | Alloying powder | | | | | |
| | Chemical composition * (mass %) | | Cooling rate after final reduction | Volume fraction of FCC phase | Addition amount (mass %) | | Formed body | Sintered body | | |
| No. | Mo | Cu | (° C./min) | (%) | Graphite powder | Cu powder | Density ($Mg/m^3$) | Density ($Mg/m^3$) | Tensile strength (MPa) | Remarks |
| 16 | 1.5 | 3.0 | 30 | 0.1 | 0.5 | 0 | 7.03 | 7.00 | 732 | Comparative example |
| 17 | 1.5 | 3.0 | 25 | 0.3 | 0.5 | 0 | 7.04 | 7.01 | 792 | Comparative example |
| 18 | 1.5 | 3.0 | 20 | 0.5 | 0.5 | 0 | 7.05 | 7.02 | 852 | Example |
| 19 | 1.5 | 3.0 | 15 | 1.5 | 0.5 | 0 | 7.07 | 7.04 | 913 | Example |
| 20 | 1.5 | 3.0 | 10 | 2.8 | 0.5 | 0 | 7.10 | 7.07 | 989 | Example |
| 21 | 1.5 | 3.0 | 5 | 3.9 | 0.5 | 0 | 7.11 | 7.08 | 998 | Example |

* The balance is Fe and inevitable impurities.

Example 3

Alloyed steel powder samples, mixed powder samples, formed bodies, and sintered bodies were prepared under the same conditions as in Example 1 except that the addition amount of Cu powder in the mixed powder was changed, and were evaluated in the same manner as in Example 1. The production conditions and evaluation results are listed in Table 3. The addition amount of a graphite powder in Table 3 represents the ratio of the mass of the graphite powder to the total mass of the alloyed steel powder and the alloying powder. The addition amount of a Cu powder in Table 3 represents the ratio of the mass of the Cu powder to the total mass of the alloyed steel powder and the alloying powder.

TABLE 3

| | Mixed powder | | | | | | | | | |
|---|---|---|---|---|---|---|---|---|---|---|
| | Alloyed steel powder | | | | Alloying powder | | | | | |
| | Chemical composition * (mass %) | | Cooling rate after final reduction | Volume fraction of FCC phase | Addition amount (mass %) | | Formed body | Sintered body | | |
| No. | Mo | Cu | (° C./min) | (%) | Graphite powder | Cu powder | Density ($Mg/m^3$) | Density ($Mg/m^3$) | Tensile strength (MPa) | Remarks |
| 22 | 1.5 | 3.0 | 10 | 2.8 | 0.1 | 0 | 7.17 | 7.14 | 803 | Example |
| 23 | 1.5 | 3.0 | 10 | 2.8 | 0.2 | 0 | 7.14 | 7.12 | 821 | Example |
| 24 | 1.5 | 3.0 | 10 | 2.8 | 0.5 | 0 | 7.10 | 7.07 | 989 | Example |
| 25 | 1.5 | 3.0 | 10 | 2.8 | 0.8 | 0 | 7.10 | 7.07 | 963 | Example |
| 26 | 1.5 | 3.0 | 10 | 2.8 | 1.0 | 0 | 7.09 | 7.06 | 902 | Example |
| 27 | 1.5 | 3.0 | 10 | 2.8 | 1.2 | 0 | 7.08 | 7.05 | 851 | Example |
| 28 | 1.5 | 3.0 | 10 | 2.8 | 1.5 | 0 | 7.07 | 7.04 | 801 | Example |
| 29 | 1.5 | 3.0 | 10 | 2.8 | 0.5 | 0.0 | 7.10 | 7.07 | 989 | Example |
| 30 | 1.5 | 3.0 | 10 | 2.8 | 0.5 | 0.5 | 7.11 | 7.07 | 1024 | Example |
| 31 | 1.5 | 3.0 | 10 | 2.8 | 0.5 | 1.0 | 7.11 | 7.07 | 1081 | Example |
| 32 | 1.5 | 3.0 | 10 | 2.8 | 0.5 | 2.0 | 7.12 | 7.06 | 1135 | Example |
| 33 | 1.5 | 3.0 | 10 | 2.8 | 0.5 | 3.0 | 7.13 | 7.06 | 1118 | Example |
| 34 | 1.5 | 3.0 | 10 | 2.8 | 0.5 | 4.0 | 7.14 | 7.06 | 1050 | Example |
| 35 | 1.5 | 3.0 | 10 | 2.8 | 0.5 | 5.0 | 7.15 | 7.05 | 980 | Example |

* The balance is Fe and inevitable impurities.

As can be seen from the results in Tables 1 to 3, in the examples satisfying the conditions of the present disclosure, the forming density was increased by precipitation of the FCC phase, with the result that each obtained sintered body had a tensile strength as high as 800 MPa or more in an as-sintered state.

The invention claimed is:

1. An alloyed steel powder for powder metallurgy comprising:

a chemical composition containing Mo: 0.5 mass % to 2.0 mass %, and Cu: 1.0 mass % to 8.0 mass %, with the balance being Fe and inevitable impurities; and a microstructure in which an FCC phase is present at a volume fraction of 0.5% to 10.0%.

2. An iron-based mixed powder for powder metallurgy, comprising:

the alloyed steel powder for powder metallurgy as recited in claim 1; and a graphite powder in an amount of 0.2 mass % to 1.2 mass % with respect to a total amount of the iron-based mixed powder for powder metallurgy.

3. The iron-based mixed powder for powder metallurgy according to claim 2, further comprising a Cu powder in an amount of 0.5 mass % to 4.0 mass % with respect to a total amount of the iron-based mixed powder for powder metallurgy.

* * * * *